United States Patent [19]

Yeager et al.

[11] Patent Number: 4,503,655

[45] Date of Patent: Mar. 12, 1985

[54] INSULATION SYSTEM FOR INNER SIDE OF EXTERIOR WALL

[75] Inventors: Raymond W. Yeager, Pataskala; Alfred Marzocchi, Newark, both of Ohio

[73] Assignee: Owens-Corning Fiberglas Corporation, Toledo, Ohio

[21] Appl. No.: 429,592

[22] Filed: Sep. 30, 1982

[51] Int. Cl.[3] ..... E04B 1/80

[52] U.S. Cl. ..... 52/747; 52/202; 52/220; 52/410

[58] Field of Search ..... 52/404, 282, 202, 203, 52/205, 204, 741, 747, 211, 410, 221, 220

[56] References Cited

U.S. PATENT DOCUMENTS

| | | | |
|---|---|---|---|
| 2,029,549 | 2/1936 | Winterich | 52/508 |
| 2,042,246 | 5/1936 | Bailey | 52/202 |
| 2,228,152 | 1/1941 | Patten | 52/410 |
| 3,255,563 | 6/1966 | Sauer | 52/404 |
| 3,412,515 | 11/1968 | Finon | 52/779 |
| 3,423,894 | 1/1969 | Richardson | 52/282 |
| 3,514,912 | 6/1970 | Smith | 52/204 |
| 3,843,191 | 10/1974 | Rediger | 52/282 |
| 3,992,829 | 11/1976 | Schellberg | 52/404 |
| 4,068,434 | 1/1978 | Day | 52/404 |

FOREIGN PATENT DOCUMENTS

| | | | |
|---|---|---|---|
| 891036 | 2/1944 | France | 52/404 |

OTHER PUBLICATIONS

Sweet's Catalog File, 1978, vol. 3, Section 7.14Ba, (3 pages) and 7.14/Gr, (8 pages).

*Primary Examiner*—John E. Murtagh

*Attorney, Agent, or Firm*—Ronald C. Hudgens; Ted C. Gillespie; Paul J. Rose

[57] ABSTRACT

The inner side of an exterior wall of an existing building is insulated by installing floor-to-ceiling panels along the wall, the panels having glass windows where the wall has windows.

2 Claims, 4 Drawing Figures

INSULATION SYSTEM FOR INNER SIDE OF EXTERIOR WALL

TECHNICAL FIELD

This invention relates to a retrofit insulation system for the inner side of exterior walls of existing buildings.

BACKGROUND ART

Increasing cost of energy for heating and cooling air in commercial buildings has created a need for a convenient aesthetic system of thermally insulating exterior walls of existing buildings. Prior to our invention, there was no practical convenient way to add additional insulation to the inner side of exterior walls of existing commercial buildings, particularly when such walls included windows.

DISCLOSURE OF INVENTION

In accordance with the invention, attractive floor-to-ceiling thermally insulating acoustical panels are conveniently mounted on the inner side of exterior walls. The panels may include glass windows.

BRIEF DESCRIPTION OF DRAWINGS

The invention in hereinafter described in greater detail with reference to the accompanying drawings in which.

BEST MODE OF CARRYING OUT THE INVENTION

Figure 1:
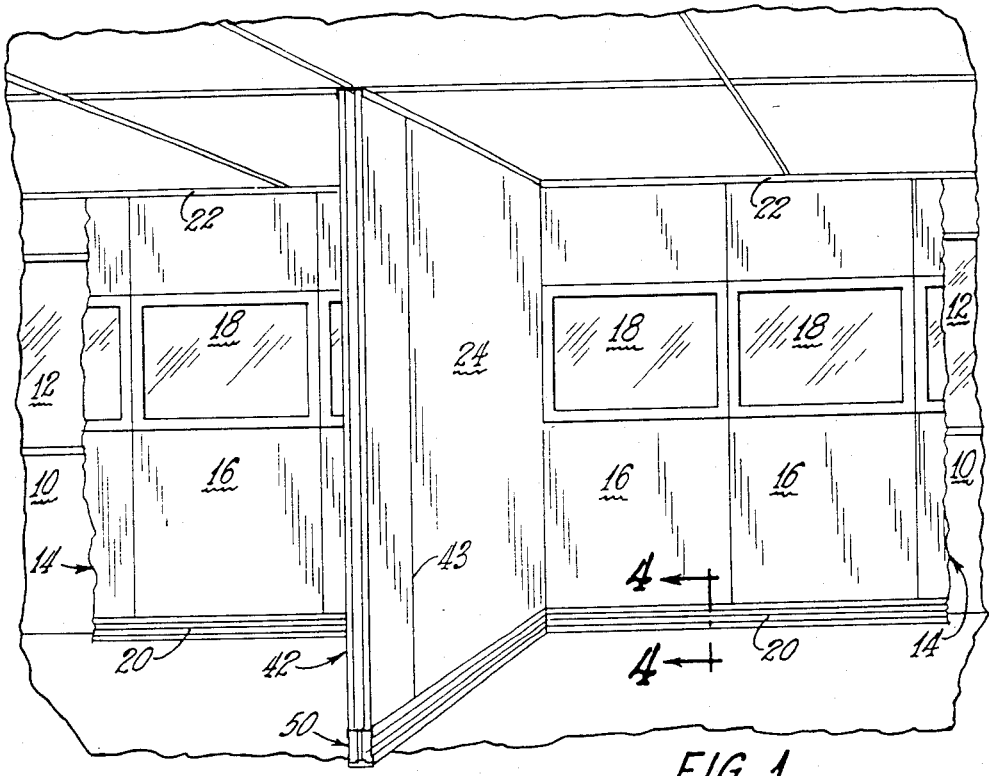
FIG. 1 is a fragmentary perspective view of the inner side of an exterior wall with insulation panels mounted thereon in accordance with the invention.
Figure 3:
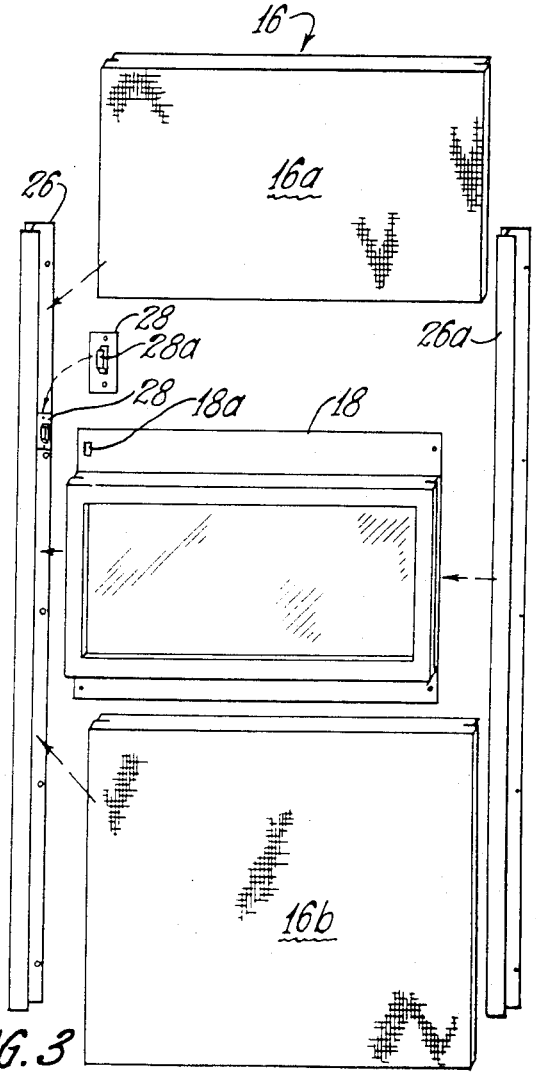
FIG. 3 is an exploded perspective view of an insulation panel with a window and two mounting splines forming part of a retrofit insulation system in accordance with the invention.

With reference to the drawings, FIG. 1 shows the inner side of an exterior wall 10 of an existing building having windows 12 therein. In accordance with the invention, a retrofit insulation system 14 is installed on the wall 10. As shown in FIG. 1, the system 14 includes a plurality of panels 16 having windows 18. The panels 16 are set in lower trim channels 20 and upper trim channels 22, the construction of the lower trim channels 20 being shown in FIG. 4 and the construction of the panels 16 being shown in FIG. 3.

Figure 2:
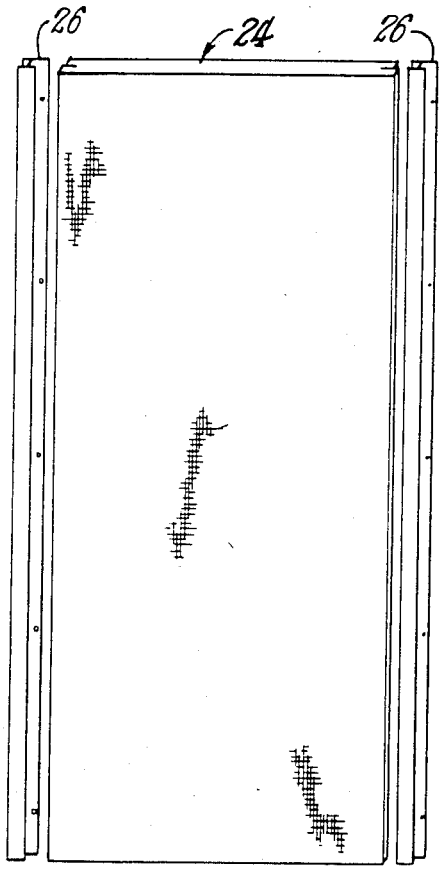
FIG. 2 is an exploded perspective view of a windowless insulation panel and two mounting splines forming part of a retrofit insulation system in accordance with the invention.

In areas (not shown) of the wall 10 where there are no windows 12, windowless panels such as a windowless panel 24 shown in FIG. 2 are installed. The panels 24 are mounted on the wall 10 by means of conventional concealed mounting splines 26 of generally H-shaped cross section. Although the trim channels 20 and 22 are sufficient to hold the panels 24 generally upright, the H-splines 26 prevent sagging or curvature away from the wall 10. One side portion of an H-spline 26 is secured to the wall 10 in any suitable manner and the other side portion is concealed in appropriate slots in vertical edge portions of an adjacent two of the panels 24. A panel 24 forming part of a partition wall 42 having a joint 43 and a dual lower trim channel 50 is shown in FIG. 1, the partition wall 42 not forming part of the insulation system 14.

The panels 16 are assembled at the job site. A bracket 28 (FIG. 3) is rivetted to an H-spline 26. The bracket 28 is shown rivetted to an H-spline 26 and is also shown separately in an enlarged view. The bracket 28 includes a hook 28*a*. After an H-spline 26 with a bracket 28 secured thereto is fastened to the wall 10, a metal framed window 18 is hung on the hook 28*a* at a hole 18*a* in the metal frame. Panel portions 16*a* and 16*b* are then put in place respectively above and below the window 18, and another H-spline 26*a* is installed on the wall 10 to retain the panel portions 16*a* and 16*b* in position. If another windowed panel 16 is to follow, a bracket 28 is first rivetted to the H-spline 26*a*.

The panel portions 16*a* and 16*b* may be cut from panels such as the panel 24. The panels are preferably thermally insulating sound absorbent glass fiber boards covered with decorative cloth.

Figure 4:
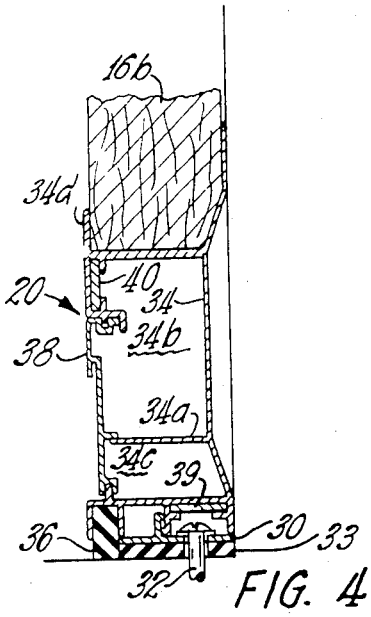
FIG. 4 is a vertical sectional view of a lower trim channel forming part of the insulation system of the invention, taken generally along the line 4—4 of FIG. 1.

A lower trim channel 20 is shown in section in FIG. 4. The trim channel 20 includes a mounting strip 30 secured to a floor by fasteners such as screws 32, one of which is shown, over an elastomeric sealing strip 33, a raceway body portion 34 mounted on the mounting strip 30 and retaining a second elastomeric sealing strip 36, and a snap-on cover 38. Alignment plates 39 and 40 are provided at joints between sections of body portions 34. A divider 34*a* of the body 34 partially defines an upper raceway 34*b* and a lower raceway 34*c* for separately housing power and communication wires. A lip 34*d* retains the lower portion of panel portions 16*b* or panels 24.

It will be seen that we have provided a convenient insulating and acoustically treating exterior walls on the inside, wherein the entire wall is covered, even when the wall contains windows and their transmitting of daylight is to be retained. Various modifications may be made in the structure shown and described without departing from the scope of the invention as set forth in the following claims.

What is claimed is:

1. A method of insulating the inner side of an exterior wall of an existing building, the wall having windows, said method comprising mounting a plurality of thermally insulating sound absorbent panels along the wall, the panels extending substantially from floor to ceiling and having glazed windows in areas corresponding to those where the wall contains windows wherein the panels are secured to the wall by H-splines and each windowed panel is assembled at the site by securing one of said glazed windows to a mounted H-spline and installing thermally insulating sound absorbent board above and below the window.

2. A method as claimed in claim 1 including installing an electrical raceway along the bottom of the wall before mounting the panels.

* * * * *